US010190080B2

(12) United States Patent
Herzog et al.

(10) Patent No.: US 10,190,080 B2
(45) Date of Patent: Jan. 29, 2019

(54) METHOD FOR CLEANING SYSTEMS

(71) Applicant: THONHAUSER GMBH, Giesshuebl (AT)

(72) Inventors: Daniel Herzog, Purkersdorf (AT); Philip Thonhauser, Giesshuebl (AT)

(73) Assignee: Thonhauser GmbH, Giessheubl (AT)

( * ) Notice: Subject to any disclaimer, the term of this patent is extended or adjusted under 35 U.S.C. 154(b) by 317 days.

(21) Appl. No.: 15/128,549

(22) PCT Filed: Mar. 24, 2015

(86) PCT No.: PCT/AT2015/050073
§ 371 (c)(1),
(2) Date: Mar. 10, 2017

(87) PCT Pub. No.: WO2015/143468
PCT Pub. Date: Oct. 1, 2015

(65) Prior Publication Data

US 2017/0191006 A1 Jul. 6, 2017

(30) Foreign Application Priority Data

Mar. 26, 2014 (AT) ..... 217/2014

(51) Int. Cl.
*C11D 3/39* (2006.01)
*C11D 3/395* (2006.01)
(Continued)

(52) U.S. Cl.
CPC ..... *C11D 3/3947* (2013.01); *B08B 9/032* (2013.01); *B67D 1/07* (2013.01); *C11D 3/3942* (2013.01);
(Continued)

(58) Field of Classification Search
None
See application file for complete search history.

(56) References Cited

U.S. PATENT DOCUMENTS

2007/0102665 A1* 5/2007 Thonhauser ..... A01N 59/02 252/186.1
2012/0093689 A1* 4/2012 Thonhauser ..... A01N 59/02 422/28

FOREIGN PATENT DOCUMENTS

DE 102006060204 A1 6/2008
EP 2764776 A1 8/2014
(Continued)

OTHER PUBLICATIONS

Int'l Search Report dated Jul. 27, 2015 in Int'l Application No. PCT/AT2015/050073.
(Continued)

*Primary Examiner* — Eric W Golightly
(74) *Attorney, Agent, or Firm* — Panitch Schwarze Belisario & Nadel LLP

(57) ABSTRACT

A method is provided for cleaning a system by conducting continuously through the system a cleaning composition including at least one oxidizing agent and an indicator for detecting the cleanliness of the system by observation of a color change of the indicator. Color values are determined at one or more points and compared with a setpoint value. Color values F are determined at fixed time intervals after exit of the composition from the system; differences ΔF are formed from two color successive values; color values are determined before commissioning of the clean system until the difference ΔF=0, after which the color value measured last is defined as an inherent system value $F_A$ and a maximum tolerable deviation from this value is fixed as a setpoint value $\Delta F_A$ for cleaning; and cleaning of the system is carried out after operation of the system until a difference of $\leq \Delta F_A$ is measured.

8 Claims, 6 Drawing Sheets

(51) Int. Cl.

| | |
|---|---|
| ***C11D 11/00*** | (2006.01) |
| ***B08B 9/032*** | (2006.01) |
| ***B67D 1/07*** | (2006.01) |

(52) U.S. Cl.
CPC ..... *C11D 3/3956* (2013.01); *C11D 11/0041* (2013.01)

(56) References Cited

FOREIGN PATENT DOCUMENTS

| | | | |
|---|---|---|---|
| GB | 1510452 | A | 5/1978 |
| WO | 0223993 | A2 | 3/2002 |
| WO | 0231098 | A1 | 4/2002 |
| WO | 2005044968 | A1 | 5/2005 |

OTHER PUBLICATIONS

Int'l Preliminary Report on Patentability dated Sep. 27, 2016 in Int'l Application No. PCT/AT2015/050073.

* cited by examiner

METHOD FOR CLEANING SYSTEMS

CROSS-REFERENCE TO RELATED APPLICATIONS

This application is a Section 371 of International Application No. PCT/AT2015/050073, filed Mar. 24, 2015, which was published in the German language on Oct. 1, 2015, under International Publication No. WO 2015/143468 A1 and the disclosure of which is incorporated herein by reference.

BACKGROUND OF THE INVENTION

The present invention relates to a method for cleaning systems while simultaneously detecting the degree of cleanliness of the system.

So-called "CIP" applications, i.e. for "clean in place" cleaning of, for example, bar or beverage dispensing systems, typically using aqueous solutions of strong oxidizing agents, entail the general problem of detecting the degree of cleanliness of the cleaned system. For this purpose, color-indicators are added to the solutions, which show a color change when exiting the system as long as they contain oxidizable (usually organic) impurities. Here, permanganate is preferably used as the strong oxidizing agent, which simultaneously provides a color-indicator system. In EP 1,343,864 A1 and EP 1,730,258 A1 (corresponding to WO 2005/044968 A1), the applicant, too, discloses water-soluble cleaning and disinfecting agents containing permanganate, wherein, in addition to permanganate, a second oxidizing agent is used, which sometimes serves as a main oxidizing agent while permanganate mainly functions as an indicator.

In many cases, for example, when using permanganate as the only oxidizing agent, i.e. at high concentrations of the indicator, it is difficult to determine via the color change if there are still oxidizable residues in the system, so that frequently more cleaning solution than necessary is used.

For solving this problem, DE 10 2006 060 204 A1 proposes, for example, a cleaning method comprising recycling of the indicator agent for reuse as an oxidizing agent. The preferred cleaning and indicator agents mentioned are the same as disclosed in the applications of the applicant cited above. In preferred embodiments, DE 10 2006 060 204 A1 provides for the measurement of a color value of the cleaning composition after exiting the system and comparing it with the color value before entering the system. As soon as the values are substantially matching, e.g. within a certain tolerance range, the system may be regarded as sufficiently cleaned. If not, one or more cleaning steps have to be repeated, as disclosed in paragraph [0020], which implies that this is a discontinuous cleaning method that is interrupted by passing an indicator solution through the system. For determining the color value, for example, a digital camera may be used, e.g. a so-called "Photo Eye" of the applicant.

The disadvantage of such a method according to DE 10 2006 060 204 A1 is that the values to be compared, i.e. the color value measured after exit from the system to be cleaned and the reference value of the indicator agent before entering the system, are measured under different conditions, as is explained in more detail below, so that they are not directly comparable. The present invention is aimed at solving this problem.

BRIEF SUMMARY OF THE INVENTION

The invention achieves this object by providing a method for cleaning a system comprising conducting through the system a cleaning composition comprising at least one oxidizing agent for oxidizing impurities and conducting through the system an indicator composition for detecting the state of cleanliness of the system by monitoring a color change of the indicator composition, to which end color values thereof are determined at one or more locations, but at least after its exit from the system, and compared to a setpoint value, the inventive method being characterized in that:

a) a cleaning composition containing a color indicator is used, which simultaneously serves as the indicator composition;
b) the composition is conducted continuously through the system;
c) the color values F of the composition after its exit from the system are determined at fixed time intervals;
d) differences ΔF are calculated between color values F obtained from two consecutive determinations;
e) before putting into operation the clean system, color values F are determined until a difference ΔF of 0 is determined, whereafter the color value measured last is defined as an inherent system value $F_A$ and a maximum tolerable deviation from said value is specified as a setpoint value $\Delta F_A$ for cleaning; and
f) cleaning of the system after its operation is carried out until the difference $\Delta F_A$ between two consecutive color values $F_R$ is equal to or smaller than $\Delta F_A$, which shows that the system is clean.

According to this method of the present invention, it is not the basic color value referred to as $F_B$ herein of the cleaning composition, which simultaneously serves as an indicator composition, before entering the system to be cleaned that is used to determine the cleanliness of the system. According to the present invention, the system is rather for "calibrating" the method, as it might be referred to, first rinsed with the composition until a constant color value is obtained. The constancy of the system-specific color value referred to as $F_A$ shows that there are no more oxidizable impurities contained in the system.

Contrary to the disclosure of DE 10 2006 060 204 A1, however, this color value cannot correspond to the basic value of the composition before its introduction into the system. Surprisingly, the inventors found that in every one of the systems that the invention mainly refers to, i.e. bar or beverage dispensing systems, there is a substantial degradation of the permanganate during its passage through the system.

Without wishing to be bound by any particular theory, the inventors believe that this is due to a contamination of the water used for preparing the composition (from concentrates or stock solutions) and sometimes also due to the air contained in the system. This effect can be observed particularly when the preferable highly-sensitive permanganate is used as the color indicator: when permanganate is used as an indicator it is possible to detect organic impurities in amounts of <0.5 mg/L.

In addition, the inventors found that this "self-degradation" depends on the temperature and also on the size of the system, i.e. on the interior surface and on the retention time therein, and of course on the accuracy during preparation of the composition.

Furthermore, it has been shown that the cascade of the degradation of permanganate to manganese(IV) oxide from the previous applications of the applicant, mentioned at the beginning, continues by itself, in particular in cooperation with a further oxidizing agent such as persulfate or hypochlorite, after it has been initiated by contact with only a smallest amount of oxidizable organic impurities. In the absence of (further) impurities, the reaction rate is clearly lower, however not zero.

It follows from this that the difference between $F_B$ and $F_A$ can, in reality, never equal zero and, in addition, varies more or less depending on several parameters. The effect of this "self-degradation" of the indicator within the system is completely eliminated by the present invention as described above.

In order to eliminate further ones of the effects described above, the method according to the present invention preferably comprises that, in step c), the inherent system value $F_A$ is determined multiple times at different temperatures of the composition and/or at different indicator concentrations and/or on different days and that a mean value is determined which is used as the inherent system value $F_A$, from which the setpoint value $\Delta F_A$ is calculated.

Thus, the value of $F_A$ can be determined multiple times using different water temperatures, within the natural variability, at different times of the year or across the entire calendar year, before the system is put into operation and after a demonstrably thorough cleaning in order to average out the effect of the temperature. Or inaccuracies occurring during mixing of the commercially available concentrates for the cleaning composition can be averaged out by varying the weighted portion, e.g. in steps of 1%, by ±5% by weight and determining the respective color values and using them for calculating a mean value. By conducting the measurements at different days, preferably at intervals of several days or weeks, for example, effects of the purity of the water and of the ambient air may also be included in the mean value.

In order to avoid idling of the system between multiple determinations, they are preferably conducted in the course of cleaning procedures after interim operation of the system. In practice, the color value of the exiting composition may, for example, be measured until constant during each routine cleaning procedure of the system, e.g. once per week, at least during the first few months of operation of the system, so that, over time, an average of $F_A$ is obtained that becomes more and more accurate by also taking into consideration variations in or effects of temperature, air and concentration.

In preferred embodiments, the inventive method may also comprise in step c) that during each of the multiple determinations of the inherent system value $F_A$ under the same temperature or concentration conditions, additionally a basic color value $F_B$ of the composition is determined without passage through the system and is correlated with the respective value of $F_A$ in order to obtain a general correlation between $F_B$ and $F_A$ that becomes more and more accurate over time in an iterating manner.

Contrary to the state of the art, this value of $F_B$ does not, however, serve as a reference point for determining the setpoint value, but merely represents an alternative or, preferably, also an addition to the multiple determinations described above. Instead of obtaining a more and more accurate average for $F_A$ over time, which takes into account temperature and other effects, "averaging out" these effects may be done ad hoc according to this preferred embodiment of the invention. After repeated, in particular frequent, conduction of the steps a) to e) and obtaining therefrom a reliable correlation between $F_B$ and $F_A$, only the basic color value $F_B$ of a specific system has to be determined in step c), while the inherent system value $F_A$ can be calculated from the correlation between $F_B$ and $F_A$. This thus clearly simplifies and accelerates the method of the invention and simultaneously provides for high accuracy of the determination of cleanliness.

The setpoint value $\Delta F_A$, which is determined based on the inherent system value $F_A$, which in turn is determined initially during "calibration" of the system and is used as a reference for the measurements during subsequent cleaning procedures, is not particularly limited and may vary depending on several factors. These mainly include the purpose of the system itself, e.g. for beverages or other food items or non-food products, the frequency of cleaning, the costs required for obtaining a certain degree of cleanliness, and the time involved, but also on the reliability of the inherent system value $F_A$. The latter mainly depends on whether the value is based on multiple determinations, and if it does, on their number and on the influences that were taken into account (e.g. temperature, water quality, etc.).

For example, the last difference $\Delta F$ above zero before achieving a constant value or a certain percentage deviation from the inherent system value $F_A$, e.g. 95% or the like, may be set as the setpoint value $\Delta F_A$. Since the inventive method mainly accomplishes saving of cleaning composition, the setpoint value may sometimes show a large deviation form $F_A$, as long as this is possible, for example, without violating relevant hygiene regulations.

For determining the color values according to the present invention, preferably a digital camera is used, and for calculating the difference values $\Delta F$, a color comparison software is used, e.g. a software which is able to convert the colors recorded by the camera into RGB values (if the camera does not directly record RGB values) and to compare these RGB values with each other, e.g. by means of a vector subtraction method, wherein the value of the difference vector corresponds to the respective difference $\Delta F$.

The cleaning composition containing a color indicator comprises in preferred embodiments permanganate as the color indicator, as well as at least one further oxidizing agent, the oxidizing potential of which is higher than that of permanganate, as has been described before, in particular peroxodisulfate, hypochlorite, or a mixture thereof, especially because of the high sensibility and strong oxidizing effect of such systems. However, other indicators than permanganate or combinations with (an) oxidizing agent(s) may also be used, for example, potassium iodide, dichromate, or dichlorophenolindophenol in combination with hydrogen peroxide or ferroin in the case of persulfate.

In addition, it should be mentioned that a "color value" herein is not necessarily an RGB value. The principle of the invention works with any physical data allowing conclusions regarding the manganese ion species in the cleaning composition exiting the system and, consequently, regarding the amount of the impurities oxidized during the recent passage of the system. This also includes, for example, photometrically measured extinction values, the refractive index, or the pH value of the cleaning composition exiting the system.

Additionally, it should be noted that the principle of the invention works not only with difference values, but also with other relations between two color value measurements carried out in chronological sequence. For example, quotients between the last two measured values may be used instead of differences, in which case the constancy of the cleaning composition is not expressed by a difference value of 0, but at a quotient of 1. In this case, however, the setpoint value may also be a percentage deviation thereof, e.g. a value of 0.95 or of 1.05, depending on whether the color value increases or decreases when approaching the constant inherent system value $F_A$. See also the explanations in the examples below, in particular with reference to FIGS. 5 and 6.

The alternative embodiments described above are in any case to be regarded as equivalent and are within the scope of the invention.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
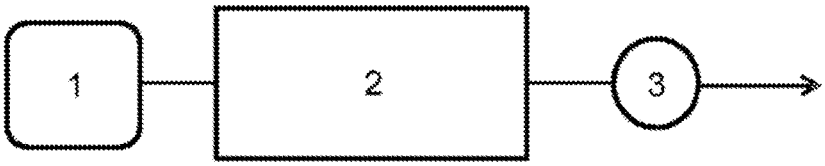
FIG. 1 is a schematic representation of a first embodiment of the method according to the invention.

A most simple embodiment of the inventive method is shown in FIG. 1. From a storage container 1, the cleaning composition is continuously conducted through a system 2 to be cleaned, whereafter it passes a sensor 3 where color values and their differences are determined in regular intervals. The duration of the time interval mainly depends on the size of the system and the corresponding retention time of the composition in the system, from entering to exiting the same. In case of a beverage dispensing system of medium size, the retention time may be, for example, approximately 15 min, in which case the determination of the color value may be conducted every 2 mins or every 5 mins.

From these measured values $F_i$ for the color value, differences $\Delta F_i$ between directly consecutively measured values are continuously calculated, and the measurement is continued (at least) until a difference of zero is measured, i.e. the current measured value corresponds to the last measured one and consequently a constant color value has been reached. This constant value shows that the system is clean and is defined as inherent system value $F_A$, which corresponds to the value that is achievable with a defined cleaning composition under given circumstances (temperature, air conditions).

Based on this guide value, a maximum tolerable deviation $\Delta F_A$ is defined that has to be achieved during the next cleaning procedure of the system after its operation in order to regard the system as sufficiently clean. As mentioned above, this setpoint value depends on several considerations and circumstances. For example, the difference >0 measured last may be used as setpoint value $\Delta F_A$. This would mean that, according to the inventive method, rinsing the system could be stopped a few minutes earlier, which would save material costs (of the cleaning composition), energy and time.

If allowed according to the cleaning requirements, however, preferably a difference higher than $\Delta F_A$ is set in order to increase the saving potential, e.g. a difference between $F_A$ and the value that was measured before the last complete passage of the system, i.e. for example the value measured 15 mins before obtaining the zero difference, or, as mentioned before, a percentage deviation from $F_A$.

In order to increase the reliability of the inherent system value $F_A$, it is determined multiple times: either several times on one day, for example, at different temperatures of the water used for preparing the cleaning composition and/or at slightly varied concentrations of the cleaning composition, or on different days, in order to also take into account the ambient air in addition to the mentioned parameters.

In particular, the value of $F_A$ is determined during every cleaning procedure of the system over a certain period of time. In this way, an average value of $F_A$ is obtained that takes into consideration several variables, so that one can be surer and surer that the system is truly sufficiently cleaned when stopping the cleaning procedure after measuring a color difference $<\Delta F_A$.

Of course, the duration of this "certain period of time" also depends on the frequency of cleaning and several other circumstances. When cleaning is conducted weekly, the $F_A$ value may, for example, be determined for several months or a whole year in order to obtain a representative average value.

In this way, according to the invention, self-degradation of the cleaning composition within the system is taken into account in the assessment of system cleanliness, which has never been done according to the state of the art.

Figure 2:
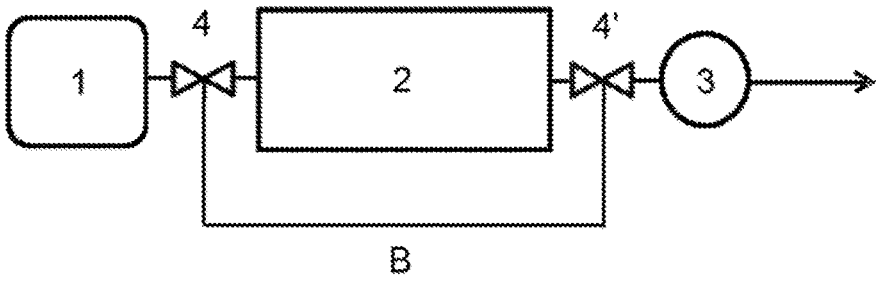
FIG. 2 is a a schematic representation of a preferred embodiment of the method of FIG. 1.

FIG. 2 shows a preferred embodiment of the method of FIG. 1, which provides for a bypass conduit B parallel with the conduit passing through system 2 through which the cleaning composition may be conducted by activating the three-way valves marked with the reference numbers 4 and 4' in the drawing without first passing through the system itself.

Such an arrangement allows for the determination of a so-called basic color value $F_B$, similar to DE 10 2006 060 204 A1. However, according to the present invention and contrary to the state of the art, $F_B$ is not determined by means of a separate sensor before entry into the system, but by the same sensor 3 downstream from the system just like during cleaning. In addition, in the method of the invention $F_B$ does not serve as a setpoint value during cleaning, but merely for a more accurate determination of the inherent system value $F_A$ or the difference $\Delta F_A$ based thereon.

By measuring the basic color value $F_B$ before the start of each cleaning procedure, variations of the day, e.g. water temperature, concentration, water and air purity, may be taken into account. The latter in particular due to the fact that, in an embodiment according to FIG. 2, the cleaning composition was in contact with the ambient air and with the conduit system for a certain time when passing through bypass conduit B, which provides a much more reliable comparative value than a measurement of $F_B$ before entry into the system—or even independently of the system, as is disclosed in DE 10 2006 060 204 A1.

Further, the basic color value $F_B$ thus measured may be compared to $F_A$, preferably with a value of $F_A$ measured on the same day, in order to obtain a more and more accurate correlation between $F_B$ and $F_A$, which may, for example, be a defined calculation formula or a calibration curve derived therefrom. After both values have been determined sufficiently often, e.g. weekly for a whole year, subsequently the corresponding value of $F_A$ may be estimated with high precision based on a measured value of $F_B$ and the obtained correlation, without the necessity of determining it. This results in a value of $F_A$ that already takes into account variations of the day (as mentioned above).

Figure 3:
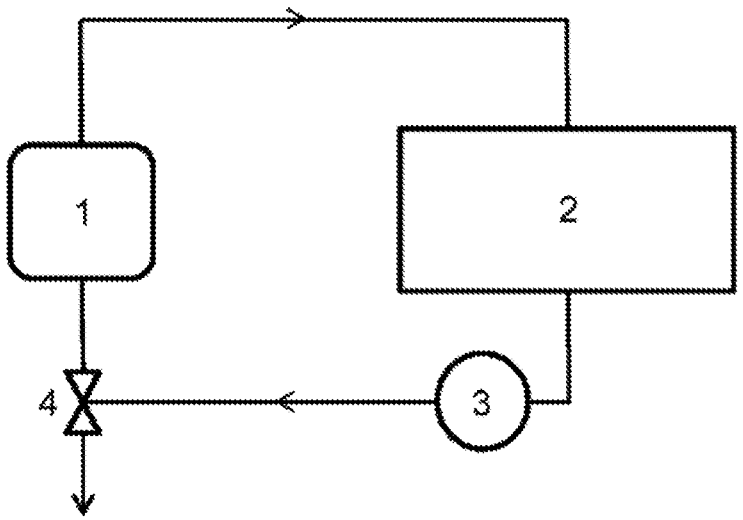
FIG. 3 is a schematic representation of another variation of the method according to the invention.

FIG. 3 shows a schematic representation of a variation of the inventive method, in which, contrary to the embodiment of FIGS. 1 and 2, the composition exiting the system is not completely removed (and sometimes discarded), but at least partly recycled and mixed with a fresh cleaning composition. Numeral 4 again refers to a three-way valve by means of which the relation between the recycled cleaning composition and the one to be discarded may be adjusted.

Figure 4:
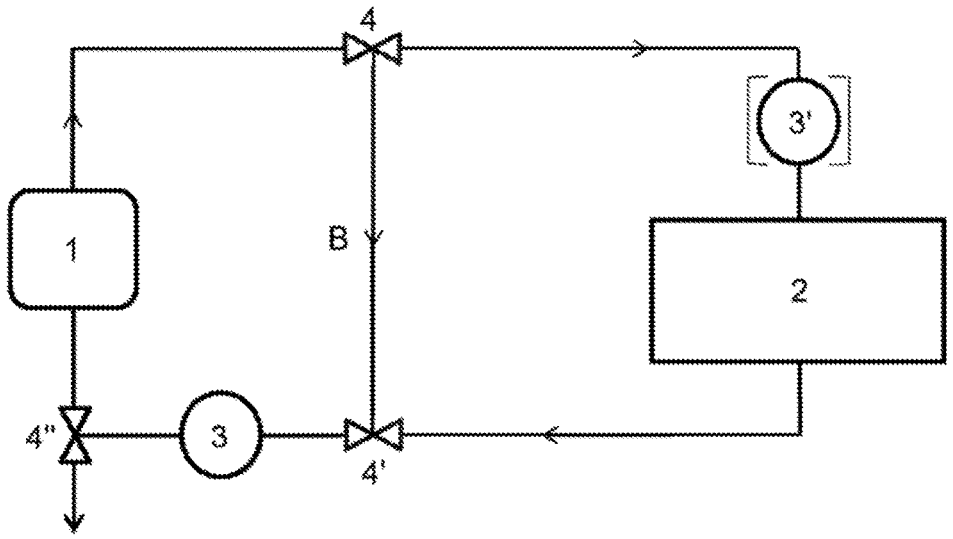
FIG. 4 is a schematic representation of a variation of the method according to the invention similar to FIG. 2.

FIG. 4 shows a similar variation to FIG. 2 with a bypass where, in addition to the arrangement of FIG. 3, the basic color value $F_B$ of the cleaning composition is measured at a sensor 3 in a bypass circuit B between the valves 4 and 4' and may be again correlated to the inherent system value $F_A$. After determining the basic color value $F_B$, the bypass B is turned off, so that the cleaning composition is led as shown in FIG. 3. By means of a valve 4", again the ratio between recycled cleaning composition and the one to be discarded may be adjusted.

Optionally—and therefore shown in brackets—an additional sensor may be provided in this arrangement of FIG. 4, which measures a further basic color value $F_{B'}$ before entry into the system, similar to DE 10 2006 060 204 A1. This value may also be correlated with either $F_A$ or $F_B$ or with both in order to further increase the accuracy of the calibration. However, the method of the invention also functions perfectly without such a second sensor.

Figure 5:
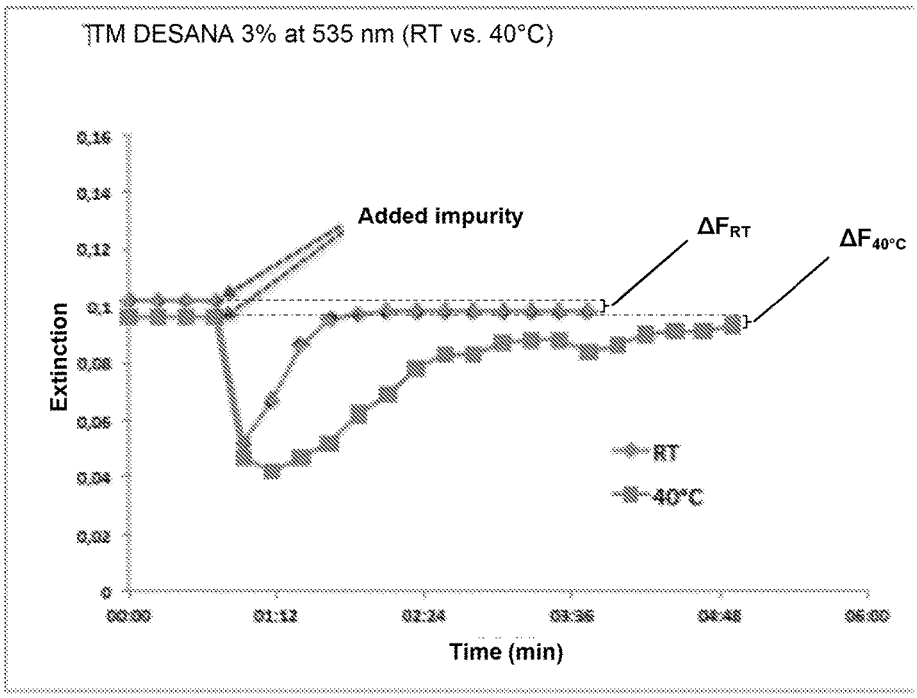
FIG. 5 shows plots of extinction values over time measured at two different temperatures and a wavelength of 535 nm while carrying out the method of FIG. 1.
Figure 6:
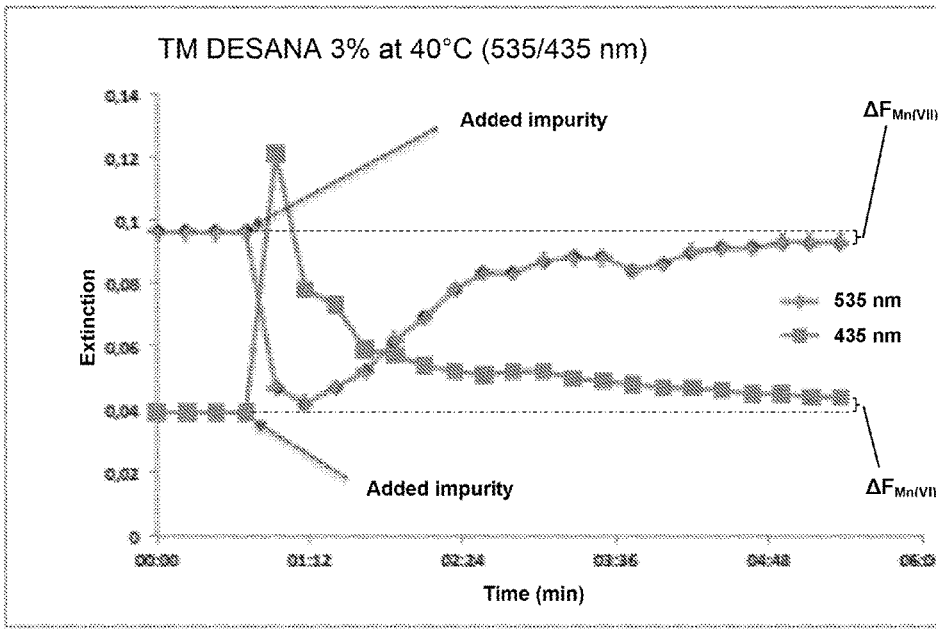
FIG. 6 shows plots similar to FIG. 5 of extinction values over time measured at a temperature of 40° C. and wavelengths of 435 nm and 535 nm while carrying out the method of FIG. 1.

Finally, FIGS. 5 and 6 show curves that were obtained by plotting values measured while carrying out the method using the measurement arrangement shown in FIG. 1. Specifically, a photometer was used to measure the extinction of a cleaning composition marketed by the applicant (TM Desana) after exiting the system 2 every 12 seconds, at two different temperatures, namely at room temperature, i.e. approx. 20° C., and at 40° C., and using different detection wavelengths. In these examples, an artificial organic impurity, namely microspheres impregnated with a malt extract, were added to the system, after which the system was cleaned with the cleaning composition, and it was observed how the composition exiting the system changed over time.

FIG. 5 shows the results of measurements at the two temperatures and at a wavelength of 535 nm, i.e. a change of the purple color due to permanganate, which is a measure for the presence of manganese(IV) in the composition. Similar behaviors were observed at both temperatures: after the impurity was added, the content of manganese(IV) abruptly decreased from the inherent system value $F_A$, plotted as the starting point at an extinction of approximately 0.1 in this case, to a minimum, but then quickly recovered—due to the small dimensions of the system after only a few seconds—and slowly approached the initial value $F_A$ again.

At room temperature (diamond-shaped measuring points), the cleaning composition reached about 95% of the initial value, i.e. of $F_A$, after approximately 1 min and from there almost asymptomatically approached the same. At 40° C. (square measuring points), this was the case only after 4 mins.

One reason for this is that at the higher temperature the residues of the microspheres with impurities that had remained at not easily accessible locations of the system (e.g. undercuts, branchings) reacted with manganese(VII) to a higher extent than at the lower temperature, but another reason is that at the higher temperature also the "self-degradation" occurs to a higher extent, i.e. the cascade mentioned above of the degradation of permanganate to manganese(IV) oxide occurring by itself at contact with only minor amounts of oxidizable organic impurities.

In FIG. 5, difference values ΔF for both measurement series are plotted, i.e. $\Delta F_{RT}$ and $\Delta F_{40°\ C.}$, that are each approximately 5% of the original extinction, i.e. of $F_A$, and may be used as the setpoint value $\Delta F_A$ for the system used in this case. In practice, i) the impurities remaining at not easily accessible positions would consist of components being part of a method conducted in the system during normal operation, which would not interfere much with the procedure itself (at least as long as they are not easily perishable food products), in particular because ii) these residual impurities are in general only contained in very small amounts, which suffice, however, to initiate the self-degradation of the permanganate.

Continuing to clean the exemplary system herein until the value is truly back at $F_A$ would take hours and would thus be rather uneconomical. Using the method of the present invention, however, allows for a very accurate estimation of how long the cleaning of the system should reasonably be continued.

It should be noted again that the inherent system value $F_A$ plotted as the starting point herein does not, in practice, correspond to the extinction value that would be obtained with the cleaning composition bevor passing the system. Due to the self-degradation of the indicator, this is actually impossible, i.e. it is unavoidable that these two values differ from each other.

In FIG. 6, the values of the experiment at 40° C. are plotted again. In addition, extinction values simultaneously measured at 435 nm are also plotted, which reflect changes of the amounts of green colored manganese(VI) species. It can be clearly seen that the two procedures are—obviously—opposite to each other: with the addition of impurities, the amount of manganese(VII) decreases and that of manganese(VI) increases. In the course of the cleaning procedure, however, both approach their initial amounts. For both, corresponding ΔF values are plotted, i.e. $\Delta F_{Mn(VII)}$ and $\Delta F_{Mn(VI)}$, which may both serve as the setpoint value $\Delta F_A$ for the cleaning procedure.

Here, it is easily recognizable that $\Delta F_A$ may be a positive or negative value, depending on the type of the color value measured. What is decisive, therefore, is only the absolute value of that difference, i.e. the extent of the color value change and thus the concentration change in the cleaning composition, not if they are negative or positive values.

The invention thus evidently provides a new method by means of which systems such as bar or dispensing systems may be cleaned much more economically than according to the state of the art.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method for cleaning a system and detecting a state of cleanliness of the system by monitoring a color change and comparing the color change to a setpoint value, the method comprising the following steps:

a) providing a cleaning composition comprising at least one oxidizing agent for oxidizing impurities and containing a color indicator;

b) continuously conducting the cleaning composition through the system;

c) determining color values F of the cleaning composition at fixed time intervals and at one or more locations including at least after exit of the cleaning composition from the system;

d) calculating differences ΔF between color values obtained from two consecutive determinations;

e) before putting a clean system into operation, determining color values until a difference ΔF=0 is determined, whereafter the color value measured last is defined as an inherent system value $F_A$ and a maximum tolerable deviation from this value is specified as a setpoint value $\Delta F_A$ for cleaning; and f) cleaning the system after its operation is carried out until the difference $\Delta F_A$ between two consecutive color values $F_R$ is equal to or smaller than $\Delta F_A$, which shows that the system is clean.

2. The method according to claim 1, further comprising determining the inherent system value $F_A$ in step c) multiple times according to at least one of the following parameters:

at different temperatures of the composition;

at different indicator concentrations; and on different days; and determining a mean value of $F_A$ which is used as the inherent system value $F_A$ from which the setpoint value $\Delta F_A$ is calculated.

3. The method according to claim 2, wherein the multiple determinations of $F_A$ are each conducted during cleaning procedures after interim operation of the system.

4. The method according to claim 2, wherein during each of the multiple determinations of the inherent system value $F_A$ in step c), under a same temperature or concentration condition, additionally determining a basic color value $F_B$ of the composition without passage through the system to be cleaned and correlating the basic color value $F_B$ with a respective value of $F_A$ to obtain a general correlation between $F_B$ and $F_A$.

5. The method according to claim 4, wherein, after repeated conduction of the steps a) to e), only the basic color value $F_B$ is determined in step c) and the inherent system value $F_A$ is calculated from the correlation between $F_B$ and $F_A$.

6. The method according to claim 1, wherein a digital camera is used for determining the color values and a color comparison software is used for calculating the differences ΔF.

7. The method according to claim 1, wherein the cleaning composition containing a color indicator comprises permanganate as the color indicator and comprises at least one further oxidizing agent whose oxidizing potential is higher than that of permanganate.

8. The method according to claim 7, wherein the further oxidizing agent is selected from peroxodisulfate, hypochlorite, and a mixture thereof.

* * * * *